United States Patent [19]

Huggins et al.

[11] 4,404,068

[45] Sep. 13, 1983

[54] SOLID STATE METHOD FOR SYNTHESIS REACTIONS

[75] Inventors: Robert A. Huggins, Stanford; Turgut M. Gur, Palo Alto, both of Calif.

[73] Assignee: Stanford University, Stanford, Calif.

[21] Appl. No.: 258,656

[22] Filed: Apr. 29, 1981

[51] Int. Cl.[3] ..... C25B 3/00; C25B 11/00; C25B 15/00

[52] U.S. Cl. ..... 204/59 R; 204/72; 204/237; 585/733

[58] Field of Search ..... 585/733; 204/59 R

[56] References Cited

U.S. PATENT DOCUMENTS 4,092,227 5/1978 Haidinger ..... 204/59 R
4,242,105 12/1980 Frost ..... 48/197 R

OTHER PUBLICATIONS

Farr and Vayenas, *J. Electrochem. Soc.*, 127, No. 7, pp. 1478–1483 (Jul., 1980).
Gur and Huggins, *J. Electrochem. Soc.*, 126, No. 6, pp. 1067–1075 (1979).
Pancharatnam et al., *J. Electrochem. Soc.*, 122, No. 7, pp. 869–875 (1975).

*Primary Examiner*—F. Edmundson
*Attorney, Agent, or Firm*—Majestic, Gallagher, Parsons & Siebert

[57] ABSTRACT

A method for synthesizing reaction products, such as hydrocarbons, from fluid reactants is provided by use of a solid state electrochemical cell. A preferred embodiment may be used to produce methane at a substantially enhanced, controllable rate.

15 Claims, 2 Drawing Figures

SOLID STATE METHOD FOR SYNTHESIS REACTIONS

BACKGROUND OF THE INVENTION

1. Field of the Invention

The present invention generally relates to a method for synthesizing reaction products by use of an electrochemical cell, and more particularly to the use of a solid state cell to substantially enhance the rate of reaction during catalytic syntheses of reaction products such as hydrocarbons.

This invention was developed under grant DMR7724222 from National Science Foundation.

2. Description of the Prior Art

Solid electrolytes, primarily cationically conducting glasses and certain commercial ceramic materials, have been sporadically employed as passive components in electrochemical cells used to measure thermodynamic quantities over a period of many years. It has also been shown that one can use a solid state cell containing doped $ZrO_2$ at elevated temperatures to measure the oxygen partial pressure in a gas over a very wide range.

Solid state electrochemical cells have also been employed in many laboratories as passive devices to measure a wide range of both thermodynamic and kinetic quantities. Devices utilizing these principles are being used in the exhaust systems of automobiles, and are being incorporated into most autos sold in California.

The active, as distinct from passive, use of such solid state ionic devices has also been developing. It has been shown in the laboratory that such systems can be used as oxygen pumps to produce extremely low oxygen activities in both static and flowing gases and liquids. Simple gases have also been decomposed (e.g. $H_2O$, CO, $CO_2$) using this approach, with oxygen being separated from the other constituents at the gas-solid surface, and being transported away through the solid electrolyte, whereas the other elements remain in the gas stream. It has been shown that one can also decompose NO by the use of solid state ionics, and measurements have indicated that the specific reaction rate for the decomposition of NO on $ZrO_2$ could be increased.

Meanwhile, there is an increasing need for new methods of producing fuels and many other chemicals from materials other than petroleum. One long known, alternate approach in the production of fuels is generally referred to as the Fischer-Tropsch synthesis reaction. This synthesis reaction utilizes hydrogen-deficient materials, such as coal, oil shale and tar sands, which are gasified with steam and oxygen to produce a gas containing CO and $H_2$. After removal of contaminates, particularly sulphur-containing species, this gas can be catalytically converted to a variety of organic products. The hydrogenation of coal provided a substantial part of Germany's fuel during World War II.

However, the cost and efficiency of the prior known catalyst-controlled synthesis processes, and the number of complicating reactions, have posed serious practical problems. Some of the problems, for example, with the Fischer-Tropsch process are related to thermodynamic limitations, slow reaction kinetics, materials limitations (particularly the catalyst) and high cost of production.

In general, synthesis reactions, such as the known Fischer-Tropsch process, are much harder to control than decomposition reactions.

DISCLOSURE OF THE INVENTION

It is an object of the present invention to provide a method for synthesizing a reaction product by use of a solid state electrochemical cell.

It is a further object of the present invention that the inventive method may be used to substantially enhance rates of reactions during catalytic syntheses, for example in the production of fuels, from feed stocks other than petroleum, and that the catalytic synthesis be substantially controllable.

One aspect of this invention is a method for synthesizing a reaction product. The inventive method comprises providing an electrochemical cell having a first electrode, a second electrode, and a solid state electrolyte. A first fluid reactant is contacted with the first electrode. The first reactant has a first moiety which is withdrawn from the first reactant and pumped away from the first electrode. A reaction product is formed at the first electrode. The reaction product formed is a product from reaction between at least a second fluid reactant and a derivative of the first reactant.

A preferred embodiment of the inventive method is in synthesizing a hydrocarbon from CO or $CO_2$ and $H_2$, for example to synthesize methane. The rate of methanation may be dramatically increased by practice of the present invention.

BEST MODE OF CARRYING OUT THE INVENTION

Figure 1:
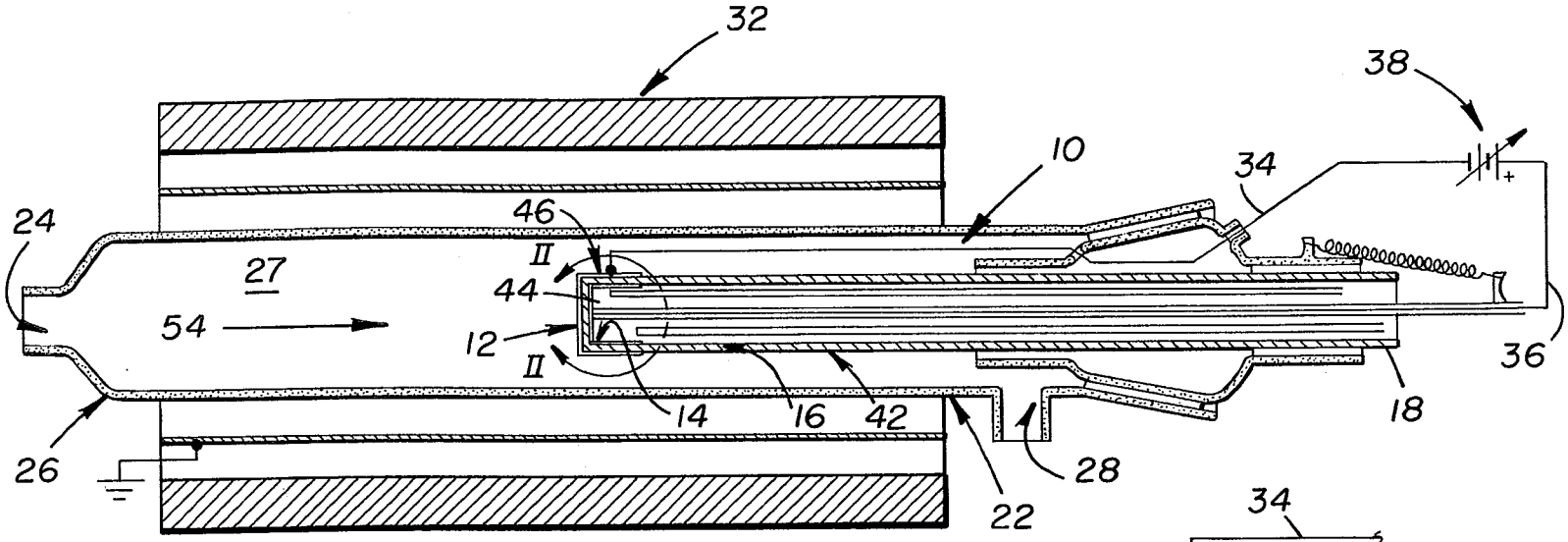
FIG. 1 is a schematic illustration of an electrochemical cell useful for practicing the present invention.

The present invention is a method for synthesizing a reaction product and comprises providing an electrochemical cell having a first electrode, a second electrode, and a solid state electrolyte intercommunicating the first and second electrodes.

A first fluid reactant is contacted with the first electrode. The electrochemical cell is operated to control the concentration, or activity, of a rate-influencing species at an interface between the first fluid and the first electrode. This control is preferably by applying a voltage across the electrolyte. At least a second fluid reactant, usually admixed with the first fluid reactant so as to form a fluid system, is contacted with first electrode.

A reaction product is formed at first electrode, whose rate of formation at the first electrode is enhanced by operation of the cell.

The inventive method may be practiced to synthesize a wide variety of compounds, for example may be utilized to produce chlorinated hydrocarbons, ammonia, amines, alcohols and so forth, from suitable systems of two, three or more fluid reactants. A one, or first, of such reactants will include a first moiety, which may be withdrawn from the first reactant, ionized by operation of the cell, and pumped across a suitably selected electrolyte. The "residue", or derivative of such a first reactant (e.g. the moiety remaining when first moiety is withdrawn) is thus available to react with at least a second reactant of the fluid system at the first electrode.

Preferred embodiments of the present invention are particularly useful for synthesizing reaction products where the first fluid reactant includes an oxygen moiety, for example where first fluid reactant is CO or $CO_2$. Thus, amines may be synthesized from a CO, $H_2$ and NO fluid system of reactants, mercaptans may be synthesized from a CO, $H_2$ and $SO_2$ fluid system of reactants, and hydrocarbons may be synthesized from a CO or $CO_2$ and $H_2$ fluid system. In these instances, it is believed that scission of the CO (or $CO_2$) bond is a rate-limiting step in the syntheses, and thus removing the oxygen moiety from chemisorbed CO (or $CO_2$) at first electrode and pumping ionic oxygen across a suitable electrolyte substantially enhances reaction between the residue and the one (or more) other reactant.

A particularly preferred use of the inventive method is where first reactant is CO or or $CO_2$, second reactant is $H_2$, and a reaction product includes methane. Where operation of the cell is at elevated temperatures on the order of about 400°-650° C., then the reaction product will be substantially entirely methane. At temperatures between about 250°-400° C., higher molecular weight hydrocarbons may be synthesized.

Operation of the cell at temperatures on the order of about 250°-400° C. can be facilitated where the solid state electrolyte is formed as a very thin layer. Although the best mode contemplated for practice of the present invention is where the solid state electrolyte is heated to an elevated temperature, for example in a range of from about 250° C. to about 650° C., room temperature operations with choice of an appropriate solid electrolyte are within the scope of the present invention.

Preferred operations of the cell reduce the concentration, or activity, of oxygen, which is ionically pumped away from the first electrode and toward the second electrode, to substantially enhance the formation of $CH_4$ or other products.

The inventive method shall now be more fully described.

Referring to FIG. 1, an electrochemical cell 10 suitable for use in the providing step of the present invention has a first, or outer, electrode 12, a second, or inner, electrode 14, and a solid electrolyte 16 intercommunicating first and second electrodes 12, 14. Cell 10 may be mounted at an end 18 distal from outer electrode 12. Cell 10 is preferably in an assembly with channeling means 22. Channeling means 22 is for channeling fluid introduced into an inlet 24 thereof to outer electrode 12. Channeling means 22 may be a jacket 26 (to which end 18 of cell 10 may be mounted), enclosing a volume 27 surrounding outer electrode 12, and having an outlet 28 adjacent to end 18 of cell 10.

The cell 10 and jacket 26 assembly is preferably disposed within a furnace 32 capable of heating electrolyte 16 to elevated temperatures, for example on the order of about 250° to about 650° C. However, end 18 of cell 10 preferably extends beyond jacket 26, and is open to the ambient atmosphere.

An electrode lead 34 is connected to outer electrode 12, and electrode lead 36 is connected to inner electrode 14. Electrode leads 34, 36 are interconnected by a variable DC power supply 38.

Electrolyte 16 may be formed in various configurations, for example as a wafer, tube or the like. A preferred configuration is as a tube 42, with a hollow interior 44 open at distal end 18 of cell 10. A closed end 46 of tube 42 carries the outer and inner electrodes 12, 14.

Figure 2:
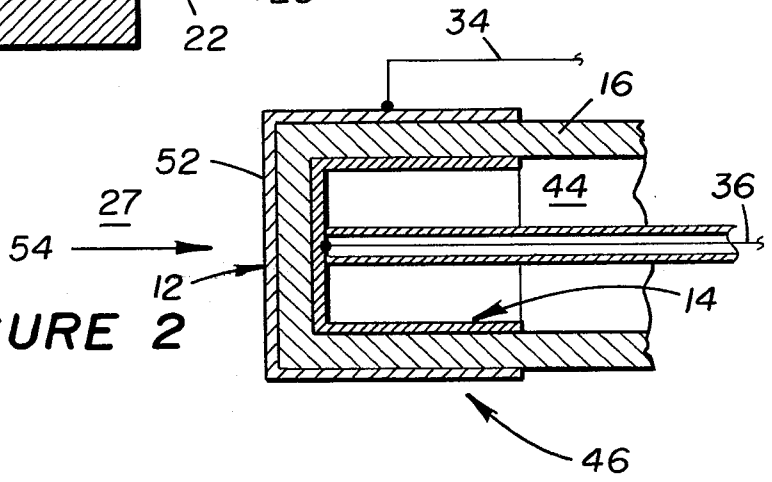
FIG. 2 is an enlarged, cross-sectional view taken of the area within line II of FIG. 1; and, FIG. 3 is a graphical data illustrating practice of the present invention.

Referring to FIG. 2, outer electrode 12 is affixed to closed end 46 and exterior thereto. Outer electrode 12 is preferably formed of nickel, cobalt, iron or a noble metal, more preferably of iron or nickel, and is affixed, or applied, to closed end 46 by various methods.

For example, where outer electrode 12 is of nickel, cobalt or iron, a paste of nickel oxide, cobalt oxide, or iron oxide, may be brushed onto closed end 46, and then fired in air at about 900° C. to remove any organic constituents as well as to obtain mechanical bonding. (The metal oxide paste may be prepared by mixing a fine powder of the metal oxide with a heavy organic vehicle.) In such a preparation, outer electrode 12 will normally have a thickness on the order of about $10^{-1}$ cm.

Electrolyte 16 is preferably formed as a very thin layer, for example on the order of about 1000-10,000 A. Thus, electrolyte 16 may be prepared by a variety of methods known to the art, such as by vacuum sputtering, chemical vapor deposition, reactive sputtering, and evaporation. Thus, for example, the electrolyte 16 material may be sputtered, deposited, or evaporated onto an ionically conducting substrate (to which the above-described paste may also be applied).

A surface 52 is exposed to volume 27, and preferably is directly interposed in a flow path (illustrated by arrow 54) which fluids would take when channeled to outer electrode 12. Surface 52 is normally defined by the exterior of outer electrode 12. However, outer electrode 12 can be porous and include interstices, so that surface 52 can be contiguous with electrolyte 16 or include areas of electrolyte 16. Also, an ionic-conducting substrate (not herein illustrated but useful where electrolyte 16 is the preferred very thin layer) may be interposed, or sandwiched, between outer electrode 12 and electrolyte 16. In any event, surface 52 is the locus of sites at which a first fluid reactant is adsorbed, as will be further discussed hereinafter.

Inner electrode 14, which is exposed to air and located at interior 44 of closed end 46, is normally made of platinum, which may be applied from a paste (available from Hanovia as platinum paste No. 6926) by brushing onto interior 44 and subsequently firing in air at about 800° C.

A suitable solid electrolyte for use in the present invention functions as a transport medium, more particularly transports, or pumps, an ionic, or electrically charged, species away from surface 52 when a voltage is applied across electrolyte 16. Electrolyte 16 thus reduces the concentration, or activity, of the species at surface 52.

Preferred materials for electrolyte 16 are those which, when heated to a suitable temperature, permit an ionic current to flow thereacross. It should be understood that use of the term "solid", or "solid state", to describe electrolyte 16 herein includes melted, or liquid, forms of electrolyte 16 during operation.

The inventive method includes contacting a first fluid reactant with outer electrode 12. The contacting step may be by statically introducing the first fluid reactant into contact with outer electrode 12, but more preferably is by flowing. Where the contacting step includes flowing, a substantially continuous stream of fluid may be introduced into channeling means 22 at inlet 24 and be flowed along path 54 into contact with surface 52. Diffusion of a reaction product, formed as described hereinafter, will thus be improved, and the reaction product will be carried in the flowing fluid steam and leave cell 10 through outlet 28.

A preferred first reactant has an oxygen moiety, and the contacting step of the present invention includes withdrawing the oxygen moiety from the first reactant at the first electrode to produce a withdrawn oxygen moiety and a deoxygenated species, or intermediate. This withdrawing is at least in part achieved wherein surface 52 is adapted to adsorb the first reactant. That is, surface 52 includes a material which functions as a catalyst in decomposing the first reactant adsorbed thereon.

The withdrawal of an oxygen moiety from an oxygen-containing species such as CO (e.g. decomposition of CO) is believed to be an important step in the known, catalytic hydrogenation of CO with $H_2$ during the Fischer-Tropsch synthesis.

However, the contacting step of the present invention preferably lowers an oxygen activity of surface 52 by pumping the withdrawn oxygen moiety away from outer electrode 12 and toward inner electrode 14. The pumping may be substantially entirely controlled by applying a selected voltage across electrolyte 16.

The best mode contemplated for practice of the present invention is where oxygen is the species to be pumped in an ionic, or electrically charged, form by electrolyte 16. A variety of materials are known and useful as solid electrolytes which will transport ionic oxygen, to thus provide a suitable electrolyte 16 for the present invention. For example, electrolyte 16 may include $ZrO_2$, $CeO_2$, $ThO_2$, or $Bi_2O_3$. Such materials are preferably doped, or stabilized, to improve conductivity and/or assist in preventing phase transformations, for example with $Y_2O_3$, $Sc_2O_3$, or CaO.

A particularly preferred material for electrolyte 16 is $ZrO_2$, which is doped, or stabilized with yttria. As is known, the yttria doping increases conductivity of a solid state electrolyte such as $ZrO_2$, and assists in preventing phase transformations of the zirconia.

The deoxygenated species, or residue of the first reactant, is reacted with at least a second fluid reactant at electrode 12 to form a reaction product. The second fluid reactant may be supplied to first electrode 12, so as to be present for reaction, in various ways. For example, the second reactant (and third reactant, if utilized) may be simultaneously introduced with the first reactant during the contacting step. Preferably, an admixture including the fluid reactants is formed, which is flowed as has previously been described.

It is within the scope of the present invention that the fluid stream having the reactants therein be liquid, gas or mixed-phase form; however, in the best mode contemplated for practice of the present invention, the fluid stream is in gaseous form, and is controlledly flowed through cell 10 at a predetermined, substantially constant space velocity and at a substantially constant, predetermined temperature.

The second (and third, if included) reactant and the deoxygenated species, or residue, derived from the first reactant form a reaction product at outer electrode 12. The formation of the reaction product is at a substantially enhanced rate by comparison to various known, catalytic displacement synthesis reactions, or by a comparison to a "control" method identical to practice of the inventive method but without the pumping. For example, a particularly preferred operation of the inventive method enhances the methanation rate of a $CO_2$ and $H_2$ mixture having a $H_2$:$CO_2$ molar ratio of 2:1 by a factor of about 83 with pumping (where outer electrode is nickel, temperature is about 650°, and pumping is with a pumping voltage of about 2.4 volts), by comparison to a "control" method without pumping.

Experimental

Aspects of the inventive method are hereinafter illustrated by syntheses of methane from CO or $CO_2$ and $H_2$ gas mixtures; however, it should be understood that the present invention is useful for synthesizing a variety of other reaction products, and particularly for synthesizing other hydrocarbons.

The gases used had the following specifications: Carbon monoxide, Research Purity grade (99.99% minimum); Hydrogen, Research Purity grade, (99.9999% minimum); Helium, 3500 psig: High Purity (99.995% minimum); and, Carbon dioxide (99.99%).

Prior to each experiment the entire cell and associated conduits were evacuated to $2\times10^{-2}$ torr in order to outgas contaminants. CO or $CO_2$ and $H_2$ gas mixtures were prepared in a one-gallon stainless steel lecture bottle by monitoring the partial pressures of CO or $CO_2$ and $H_2$ up to the desired values. The CO or $CO_2+H_2$ mixture was then diluted by pressurizing the lecture bottle with He. The flow of the gas mixture from the bottle was regulated by a fine needle-valve, and the constancy of flow visually observed by a rotometer. Most experiments were conducted at a substantially constant flow rate of about 6 ml/min. The gas mixture was introduced into a chamber and passed through a glass-bead trap immersed in dry ice to assure both complete mixing and removal of traces of moisture. The CO or $CO_2+H_2$ mixture was then introduced, or flowed, into the solid state electrochemical cell 10, as previously described. The gases leaving the cell through outlet 28 were analyzed in a Varian Aerograph Model 142010 gas chromatograph featuring a dual column thermal conductivity detector, linear temperature programmer and a built-in gas sampling valve. A ⅛" OD×12' column packed with 80/100 mesh Chromosorb-106 (available from Varian Associates) was used in the gas chromatograph for the analyses of $H_2$, CO, $CO_2$, $H_2O$, $CH_4$ and higher hydrocarbons.

Voltages up to about 3.3 volts were applied across electrolyte 16 from a DC power supply. Care was taken that the true potential drop, or $E_{pump}$, across the electrolyte did not exceed the decomposition voltage of $ZrO_2$ (about 2.2 volts at the temperatures utilized). The current through the electrolyte was measured by a Keithley multimeter.

The $H_2+CO$ or $CO_2$ mixtures used in the experiments had a range of $H_2/CO$ ratios varying from about 1 to 9, and the $H_2/CO_2$ ratio was varied between about 0.5 and 2.

The rate of hydrocarbon formation on the outer electrode was calculated by the rate equation (1) given below which assumes that the rate is first order with respect to methane:

$$'CH_4 = \frac{N}{A} f_m (X^{out}_{CH_4} - X^{in}_{CH_4}) \quad (1)$$

Here, N is Avogadro's number, A is the area, $f_m$ is the molar flow rate and X is the mole fraction. The area (e.g. surface 52 of outer electrode 12) was estimated to be equal to a geometric area of 10 $cm^2$ to a first approximation.

The current-voltage characteristics of each individual cell may be depicted in I-$E_{pump}$ plots, where I is the steady state current and the pumping voltage, and $E_{pump}$ is defined by equation (2), below:

$$E_{pump}=E_{appl}-E^{\circ} \quad (2)$$

Here E° is the open circuit emf of the cell measured by a potentiometer and $E_{appl}$ is the externally applied voltage such that the inner, or air side, electrode 14 has the positive polarity.

Figure 3:
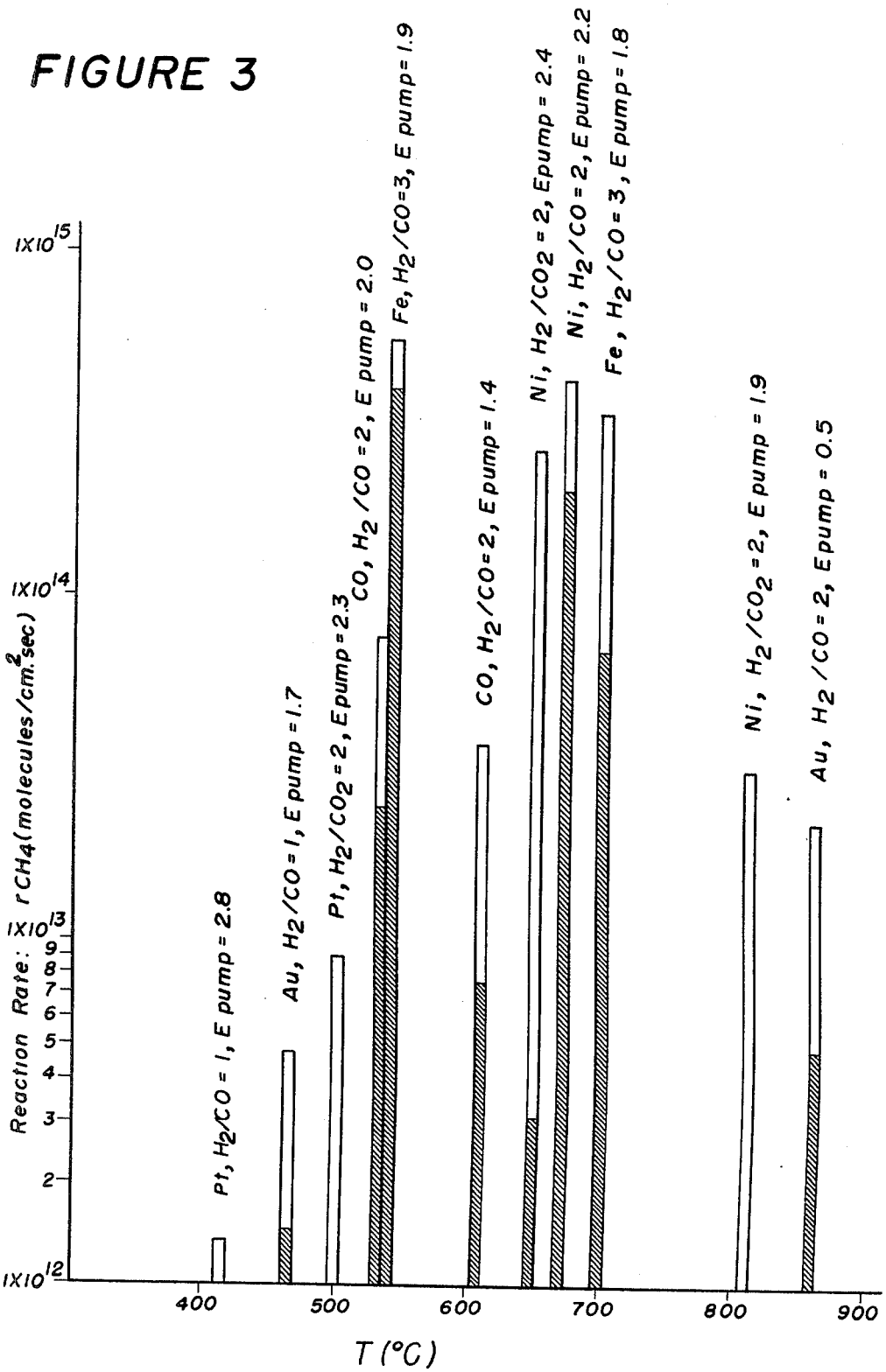

Referring to FIG. 3, data from various electrochemical cells having platinum, gold, cobalt, iron or nickel as materials for the outer electrode illustrate practice of the present invention. The eleven bars of FIG. 3 illustrate formation of methane at rates of molecules/cm$^2$.sec from CO or $CO_2$ as the first reactant and $H_2$ as the second reactant between temperatures of about 400° C. to about 850° C.

The shaded areas of eight bars represent an intrinsic catalytic activity of the electrochemical cell (e.g. $E_{appl}=0$), and the unshaded areas of all eleven bars represent the electrochemical contribution to, or enhancement of, the rate of reaction product formation. Thus, for example, the bar at about 650° C. shows that a fluid gas stream including $H_2$ and $CO_2$ in a molar ratio of 2:1, flowed at a substantially constant space velocity into contact with a nickel outer electrode, reacted to form methane at a rate of about $2.6\times10^{14}$ molecules/cm$^2$.sec with an $E_{pump}$ voltage of about 2.4. ($E_{appl}=3.4$). By comparison, when $E_{appl}=0$, the reaction rate was only about $3.1\times10^{12}$ molecules/cm$^2$.sec.

As is illustrated by the three bars without any shading, some outer electrode materials, which had no detectable intrinsic activity under the specified operating conditions without pumping, were activated only upon pumping.

The rate of methane formation is strongly dependant on the voltage across the electrochemical cell, which in turn is related to the oxygen activity at surface 52 through the Nernst equation, expressed as equation (3) below:

$$E = -\frac{RT}{nF}\ln\left[\frac{(a_{o2})^{II}}{(a_{o2})^{I}}\right] \quad (3)$$

Since $(a_{o2})$ is fixed by air where $p_{02}{}^{I}=0.21$ atm, the oxygen activity, $(a_{o2})^{II}$, at the catalyst/fluid stream interface is entirely controlled by the voltage at constant temperature.

We claim:

1. A method for synthesizing a reaction product comprising the steps of:

providing an electrochemical cell having a first electrode, a second electrode, and a solid state electrolyte intercommunicating said first and second electrodes, said electrolyte adapted to permit ions to flow thereacross;

contacting a first fluid reactant with said first electrode, said first fluid reactant having a first moiety, the contacting including electrochemically separating said first moiety from said first reactant at said first electrode to form an ionic withdrawn first moiety and a first reactant residue and pumping said ionic withdrawn first moiety away from said first electrode and toward said second electrode, the pumping of said withdrawn first moiety including transporting said withdrawn first moiety in said solid state electrolyte; and, forming a reaction product at said first electrode in the presence of at least a second fluid reactant, said reaction product derived from said first reactant residue and at least said second reactant.

2. The method as in claim 1 wherein:

the pumping of said withdrawn first moiety includes applying a voltage across said electrolyte.

3. The method as in claim 1 wherein:

the forming of said reaction product is conducted at a surface, said surface being located at an interface between said first reactant and said first electrode.

4. The method as in claim 2 wherein:

the pumping includes heating said electrolyte to an elevated temperature.

5. The method as in claim 1 or 2 wherein:

said first and said at least second fluid reactants are in gaseous form.

6. The method as in claim 5 wherein:

the contacting step includes flowing said first and said at least second fluid reactants to said first electrode.

7. The method as in claim 1 wherein:

said first moiety is an oxygen moiety, the withdrawn first moiety is an ionic oxygen moiety, and the pumping of the withdrawn oxygen moiety includes lowering an oxygen activity at a surface, said surface being located at an interface between said first reactant and said first electrode.

8. The method as in claim 6 wherein:

said first reactant is CO or $CO_2$ and said second reactant is $H_2$.

9. The method as in claim 8 wherein:

said reaction product is methane.

10. The method as in claim 6 wherein:

said first reactant is CO and said second reactant is $H_2$, said $H_2$ being in a molar ratio with respect to said CO of between about 1 to about 9.

11. The method as in claim 6 wherein:

said first reactant is $CO_2$ and said second reactant is $H_2$, said $H_2$ being in a molar ratio with respect to said $CO_2$, of between about 0.5 to about 2.

12. The method as in claim 3 wherein:

said surface is a catalyst adapted to adsorb said first reactant.

13. The method as in claim 12 wherein:

said surface includes nickel, cobalt, iron or a noble metal.

14. A method for synthesizing a hydrocarbon comprising the steps of:

providing an electrochemical cell having a first electrode, a second electrode, and a solid state electrolyte intercommunicating said first and second electrodes, said solid state electrolyte adapted to transport ionic oxygen therethrough;

flowing at least two gaseous reactants to said first electrode, a first reactant of said at least two gaseous reactants including an oxygen moiety, a second reactant of said at least two gaseous reactants being hydrogen;

controlledly lowering an oxygen activity of a surface, said surface being located at an interface between said first electrode and said first reactant to form a hydrocarbon at said surface, said hydrocarbon being a reaction product derived from said first reactant and said second reactant, the controlled lowering of said oxygen activity including electrochemically separating said oxygen moiety from said first reactant as an ionic oxygen moiety, and transporting said ionic oxygen moiety away from said surface in said electrolyte.

15. The method as in claim 14 wherein:

the controlled lowering of said oxygen activity includes applying a voltage across said electrolyte.

* * * * *